US006547891B2

(12) United States Patent
Lindén et al.

(10) Patent No.: US 6,547,891 B2
(45) Date of Patent: Apr. 15, 2003

(54) ELONGATED PERCUSSIVE ROCK DRILLING ELEMENT

(75) Inventors: Johan Lindén, Gävle (SE); Lars-Gunnar Lundell, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/784,169

(22) Filed: Feb. 16, 2001

(65) Prior Publication Data

US 2001/0023718 A1 Sep. 27, 2001

(30) Foreign Application Priority Data

Feb. 16, 2000 (SE) ..... 0000521

(51) Int. Cl.[7] ..... C22C 38/18; C22C 38/22; C22C 38/20

(52) U.S. Cl. ..... 148/325

(58) Field of Search ..... 148/325, 333, 148/334

(56) References Cited

U.S. PATENT DOCUMENTS 4,127,043 A * 11/1978 Evans ..... 76/108 A
4,303,137 A * 12/1981 Fischer ..... 175/374
4,450,006 A * 5/1984 Uyehara et al. ..... 420/40
4,919,728 A * 4/1990 Kohl et al. ..... 148/579
5,433,798 A * 7/1995 Takano et al. ..... 148/325
5,496,421 A 3/1996 Hashizume et al.
5,944,921 A 8/1999 Cumino et al.
5,988,301 A * 11/1999 Lundell ..... 175/320
6,159,311 A * 12/2000 Amay et al. ..... 148/325

FOREIGN PATENT DOCUMENTS

GB 2168737 A * 6/1986 ..... 175/337
JP 59173245 10/1984
JP 8013084 1/1996

* cited by examiner

*Primary Examiner*—Deborah Yee
(74) *Attorney, Agent, or Firm*—Burns, Doane, Swecker & Mathis, LLP

(57) ABSTRACT

The present invention relates to a martensitic, corrosion resistant steel for rock drilling with properties which is adjusted essentially with regard to resistance against corrosion fatigue. This has been obtained in that an elongated element for percussive rock drilling which includes at least a thread and a flush channel has been made with corrosion resistant steel having a mainly martensitic structure.

8 Claims, 1 Drawing Sheet

ELONGATED PERCUSSIVE ROCK DRILLING ELEMENT

FIELD OF THE INVENTION

The present invention relates to a martensitic, corrosion resistant steel for rock drilling, with new and improved properties, particularly with regard to resistance against corrosion fatigue.

BACKGROUND OF THE INVENTION

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

During percussive rock drilling shock waves and rotation are transferred from a drill machine via one or more rods or tubes, to a cemented carbide equipped drill bit. The drill steel, i.e. the material in bits, rods, tubes, sleeves and shank adapters is subjected to corrosive attack. This applies in particular to underground drilling where water is used as flushing medium and where the environment in general is humid. The corrosive attacks are particularly serious in the most stressed parts, i.e. thread bottoms and thread clearances. In combination with pulsating stress, caused by bending stresses and the above-mentioned shock waves, so-called corrosion fatigue arises (FIG. 1). This is a common cause of failure of the drilling steel.

A low-alloyed, case hardened steel is normally used for the drilling application. The reason is that abrasion and wear of the thread parts have generally been limiting for life. As the drilling machines and tools have become more efficient, these problems have diminished and corrosion fatigue has become a limiting factor. The case hardening gives compressive stresses in the surface, which gives certain retarding effects on the fatigue.

U.S. Pat. No. 5,496,421 relates to a high strength martensitic stainless steel. The steel contains: 0.06 wt-% or less C, 12 to 16 wt-% Cr, 1 wt-% or less Si, 2 wt-% or less Mn, 0.5 to 8 wt-% Ni, 0.1 to 2.5 wt-% Mo, 0.3 to 4 wt-% Cu, 0.05 wt-% or less N, and the balance being Fe and inevitable impurities; said steel having an area ratio of delta-ferrite phase of at most 10%. The known steel intends to solve the problem of stress corrosion caused by an acidic environment.

SUMMARY OF THE INVENTION

One object of the present invention is to provide an elongated element for percussive rock drilling which further improves the efficiency of modern mining.

Another object of the present invention is to provide an elongated element for percussive rock drilling with increased life.

Still another object of the present invention is to provide a drill steel with reduced corrosion rate.

Still another object of the present invention is to provide a drill steel with reduced sensitivity for corrosion fatigue.

According to one aspect, the present invention provides a steel for an elongated element used in percussive rock drilling including at least a thread and flush channel, the steel is corrosion resistant and has a mainly martensitic microstructure.

According to a further aspect, the present invention provides a steel adapted for use in percussive rock drilling, the steel being corrosion resistant and having a martensite content of >50 wt-% but <100 wt-%, the steel having a composition comprising at least one of:

$C+N \geqq 0.1$ wt-% and $Cr \geqq 11$ wt-%;

$C+N \geqq 0.1$ wt-% and $Cr \geqq 5$ wt-%, $Mo \leqq 5$ wt-%, $W \leqq 5$ wt-%, $Cu \leqq 2$ wt-%;

$Mo+W+Cu > 0.5$ wt-%; or $C+N \geqq 0.1$ wt-% and $Cr+3.3(Mo+W)+16N > 10$ wt-%.

According to one aspect, the present invention provides an elongated element for percussive rock drilling including at least a thread portion and flush channel, at least the thread is made of a corrosion resistant steel with a mainly martensitic structure.

According to another aspect, the present invention provides an elongated element for percussive rock drilling including at least a thread portion and flush channel, at least the thread portion is made of a corrosion resistant steel having a martensite content of >50 wt-% but <100 wt-% and that the steel has a composition comprising at least one of:

$C+N \geqq 0.1$ wt-% and $Cr \geqq 11$ wt-%;

$C+N \geqq 0.1$ wt-% and $Cr \geqq 5$ wt-%, $Mo \leqq 5$ wt-%, $W \leqq 5$ wt-%, $Cu \leqq 2$ wt-%;

$Mo+W+Cu > 0.5$ wt-%; or $C+N \geqq 0.1$ wt-% and $Cr+3.3(Mo+W)+16N > 10$ wt-%.

According to yet another aspect, the present invention provides a use for a steel having a mainly martensitic microstructure, the use comprising forming at least a thread portion of an elongated element for percussive rock drilling from the steel.

DETAILED DESCRIPTION OF THE INVENTION

Figure 2:
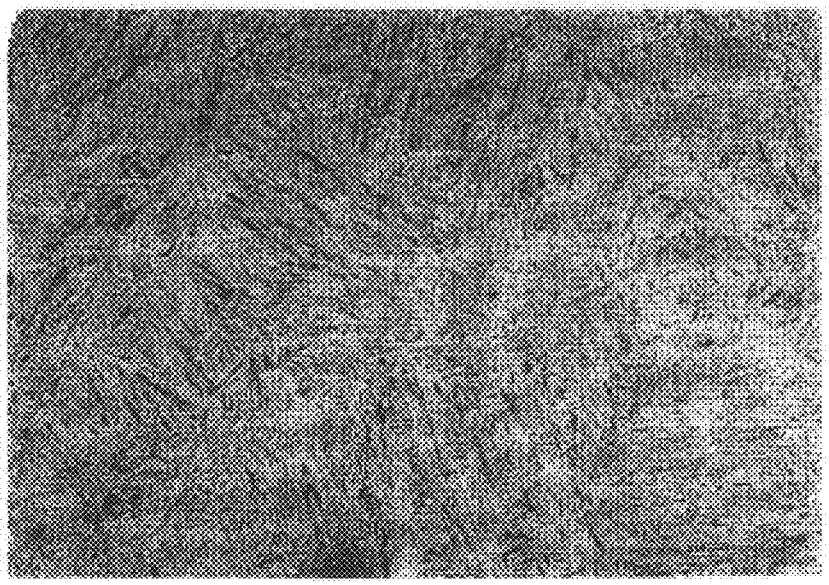
FIG. 2 shows, at 500×, the structure of a drilling steel according to the invention.

The invention relates to a steel for rock drilling made from a corrosion resistant alloy with a martensitic matrix where the corrosion resistance is obtained by additions of Cr as well as Mo, W, Cu and/or N. Through the martensitic structure, (FIG. 2), the necessary strength and core hardness for the application is obtained. Preferably the martensite content is >50 wt-% but <100 wt-%, preferably >75 wt-%. The ultimate tensile strength shall be >800 MPa, preferably 1300–3000 MPa.

Figure 1:
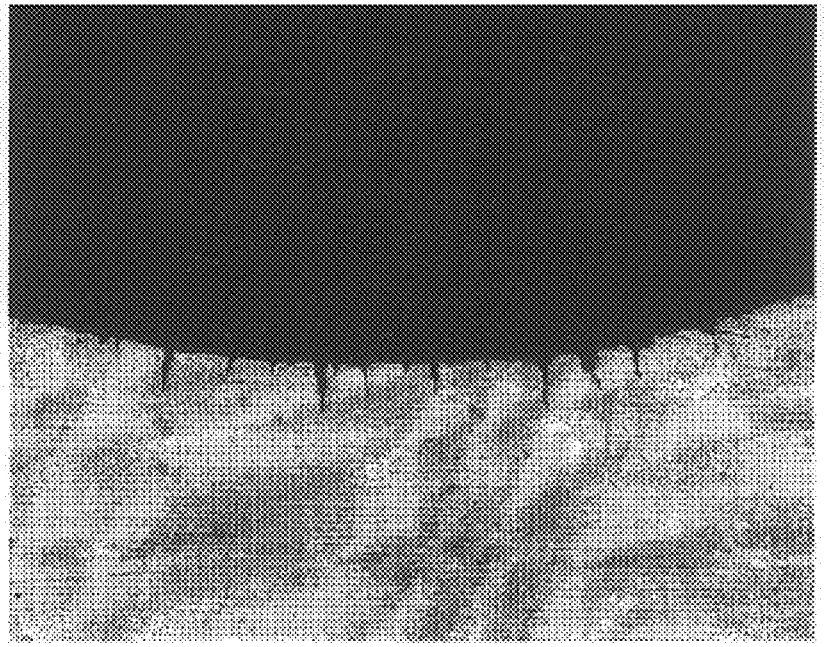
FIG. 1 shows, at 25×, cracks in a thread bottom in a low-alloyed steel.

By making the drilling steel from a corrosion resistant alloy, thanks to the chromium addition, a passive layer on the surface is obtained, which prevents corrosion or reduces the corrosion rate and thereby the corrosion fatigue, especially in thread bottoms such as is shown in FIG. 1. In order for the drilling steel according to the invention to be sufficiently corrosion resistant it is required that it has a chromium content of at least 11%. The total content of carbon and/or nitrogen (C+N) must be >0.05%, preferably 0.1–0.8%.

Alternatively the chromium content can be lower than 11%, down to 5%, which then can be compensated for by the addition of molybdenum (up to 5%, preferably 0.5–2 wt-%), tungsten (up to 5%, preferably 0.5–2 wt-%) and/or copper (up to 2%, preferably 0.1–1 wt-%), wherein the total content Mo+W+Cu>0.5%, preferably >1 wt-%.

Still another alternative is that the alloy has a composition which gives a PRE-number >10, preferably 12–17. PRE means Pitting Resistance Equivalent and describes the resistance of an alloy against pitting corrosion. PRE is defined according to the formula: PRE=Cr+3.3(Mo+W)+16N; where Cr, Mo, W and N correspond to the contents of the elements in weight percent.

A steel according to the invention shall also have a surface hardness of more than 400 Vickers, preferably 500–800 Vickers in order to further increase its resistance against abrasion caused by e.g. movements in threaded joints, drill cuttings or contact with the surrounding rock (the bore wall). Preferably the steel has a 0.5–2.0 mm thick surface layer with increased hardness.

Drilling steel according to the invention are made by conventional steel rod production and machining. In order to obtain the desired martensitic structure the steel is hardened or cold worked. The wear resistance can be further improved by induction hardening of the surface or by applying surface treatment methods such as carburizing and nitriding. The invention also relates to the use of a steel according to the invention as a drilling steel.

Instead of performing the whole element in steel according to the invention one or both thread ends can be performed according to the invention and be welded or joined on to a rod or a tube of another material.

EXAMPLE

In so called drifter drilling about 4 m long rods are used. The critical part of the rods are the bottoms on the male threads such (as shown in FIG. 1) where the flushing water and pulsating stresses give rise to corrosion fatigue which frequently results in fracture.

Drifter rods were made of three alloys with compositions according to the following:

| Test | % C | % Cr | % Ni | % Mo | % W | % Cu | % N | % Fe | Martensite content |
|---|---|---|---|---|---|---|---|---|---|
| 1–4 | 0.18 | 13.4 | 0.3 | 0.02 | 0.01 | 0.12 | 0.012 | Rest | 98% |
| 5–8 | 0.50 | 14.3 | 0.15 | 0.02 | 0.01 | 0.06 | 0.011 | Rest | 89% |
| 9–12 | 0.35 | 11.9 | 0.22 | 1.05 | 0.01 | 0.06 | 0.013 | Rest | 95% |

Drilling was performed in a rig for drifter drilling underground and the drilling was continued until fracture/wear. The following useful lifetimes of the rods, measured in drilled meters, were achieved:

| Test no | 1 | 2 | 3 | 4 | 5 | 6 |
|---|---|---|---|---|---|---|
| Drilled meters | 3299 | 2904 | 3030 | 2876 | 2893 | 3121 |
| Test no | 7 | 8 | 9 | 10 | 11 | 12 |
| Drilled meters | 2976 | 2656 | 2628 | 2189 | 3222 | 2929 |

Normal lifetime for drifter rods of conventional type, i.e. of low-alloyed, case hardened steel, is at the test site in question where the rock primarily consists of granite, is about 2000 m. Thus, use of a drilling steel according to the invention gives a remarkable improvement.

In other words all steels according to the present invention contain the common feature of C+N≧0wt-% such that a preferred steel is selected from one of the compositions listed below:

C+N≧0.1 wt-% and Cr≧11 wt-%, or

C+N≧0.1 wt-% and Cr≧5 wt-%, Mo≦5 wt-%, W≦5 wt-%, Cu≦2 wt-%, Mo+W+Cu>0.5 wt-%, or C+N≧0.1 wt-% and Cr+3.3(Mo+W)+16N>10 wt-%.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

We claim:

1. An elongated percussive rock drilling element including at least a thread portion and flush channel, at least the thread portion is made of a corrosion resistant steel having a martensite content of >50 wt-% but <100 wt-% and that the steel has a composition comprising:

0.1 wt-%≦C+N≦0.8 wt-% and Cr≧11 wt-%.

2. The element according to claim 1, wherein the martensite content is >75 wt-%.

3. An elongated percussive rock drilling element including at least a thread portion and flush channel, at least the thread portion is made of a corrosion resistant steel having a martensite content of >75 wt-% but ≦98 wt-% and that the steel has a composition comprising:

0.1 wt-%≦C+N≦0.8 wt-% and Cr≧11 wt-%.

4. The element according to claim 1, wherein the composition further comprises Mo≦5 wt-%, W≦5 wt-%, and Cu≦2 wt-%.

5. The element according to claim 1, wherein the composition further comprises Cr+3.3 (Mo+W)+16N>10.

6. An elongated percussive rock drilling element including at least a thread portion and flush channel, at least the thread portion is made of a corrosion resistant steel having a martensite content of >50 wt-% but <100 wt-% and that the steel has a composition comprising:

0.1 wt-%≦C+N≦0.8 wt-% and Cr≧10 wt-%.

7. The element according to claim 1, wherein the amount of Cr in the composition is greater than or equal to 11.9%.

8. The element according to claim 7, wherein the amount of Cr in the composition is less than or equal to 13.4%.

* * * * *